US005139343A

United States Patent [19]

Lin

[11] Patent Number: 5,139,343

[45] Date of Patent: Aug. 18, 1992

[54] LAMP HOLDER WITH SWITCH MEANS

[76] Inventor: Wen-Hsiung Lin, 11-6F, No. 2, Chung Shan Rd., Sec. 1, Panchiao City, Taipeihsien, Taiwan

[21] Appl. No.: 820,230

[22] Filed: Jan. 14, 1992

[51] Int. Cl.[5] ..... F21V 23/04

[52] U.S. Cl. ..... 362/226; 362/295; 362/394; 439/513; 200/51.1

[58] Field of Search ..... 362/226, 295, 394, 20, 362/211, 212, 227, 251; 439/611, 612, 619, 509, 513; 200/51.1, 51.09

[56] References Cited

U.S. PATENT DOCUMENTS

| | | | |
|---|---|---|---|
| 932,139 | 8/1909 | Kempton | 200/51.1 |
| 1,536,332 | 5/1925 | Dam | 439/513 |
| 2,984,813 | 5/1961 | Bossi | 439/619 |
| 3,182,185 | 5/1965 | Ahroni et al. | 362/226 |
| 3,286,088 | 11/1966 | Ahroni | 362/226 |
| 3,522,579 | 8/1970 | Masuya | 439/619 |

*Primary Examiner*—Richard R. Coll
*Attorney, Agent, or Firm*—Bacon & Thomas

[57] ABSTRACT

For a decorative string or Christmas tree light assembly, a lamp holder comprising a major lamp base supported on an auxiliary lamp base to holder a lamp socket, the major lamp base having a switch at a bottom thereof, the switch having two opposite ends respectively connected to the electric circuit of a decorative string or Christmas tree light assembly, and wherein disconnecting the lamp socket from the major lamp base causes a conductive spring in the auxiliary lamp base to connect the switch permitting the electric circuit of such decorative string or Christmas tree light assembly to be constantly electrically connected.

2 Claims, 5 Drawing Sheets

LAMP HOLDER WITH SWITCH MEANS

BACKGROUND OF THE INVENTION

The present invention relates to lamp holders and relates more particularly to a lamp holder for a decorative string or Christmas tree light assembly which utilizes a switch to detect the connection of a lamp socket in each lamp holder in a decorative string or Christmas tree light assembly.

In a decorative string or Christmas tree light assembly, each lamp holder is made from a plastic tube having two opposite copper leaves respectively connected to an electric power supply by lead wires. Once the lamp socket of a lamp bulb is inserted in a lamp holder, the two conductors of the lamp socket contact the two copper leaves of the lamp holder, and therefore, the lamp bulb is electrically connected to emit light. Because the lamp holders of a decorative string or Christmas tree light assembly are connected in series, either lamp holder is disconnected or damaged, the whole electric circuit of the decorative string or Christmas tree light assembly becomes broken. Once the electric circuit of a decorative string or Christmas tree light assembly is broken, all the lamp holders must be checked one after another.

SUMMARY OF THE INVENTION

The present invention has been accomplished under the aforesaid circumstances in view. It is therefore an object of the present invention to provide a lamp holder with switch means for a decorative string or Christmas tree light assembly which makes the inspection of the electric circuit of a decorative string or Christmas tree light assembly easy. It is another object of the present invention to provide a lamp holder with switch means for a decorative string or Christmas tree light assembly which permits the electric circuit of a decorative string or Christmas tree light assembly to be constantly electrically connected even if any lamp holders thereof are damaged or disconnected from the electric circuit.

According to the present invention, a switch is fastened inside a major lamp base which permits the electric circuit of a decorative string or Christmas tree light assembly to be constantly electrically connected even if either lamp socket of such decorative string or Christmas tree light assembly is disconnected or damaged. A conductive spring is fastened inside an auxiliary lamp base to electrically connect the switch when the lamp socket is damaged or disconnected from position, permitting the electric circuit of the decorative string or Christmas tree light assembly to be constantly electrically connected.

DETAILED DESCRIPTION OF THE PREFERRED EMBODIMENT

Figure 1:
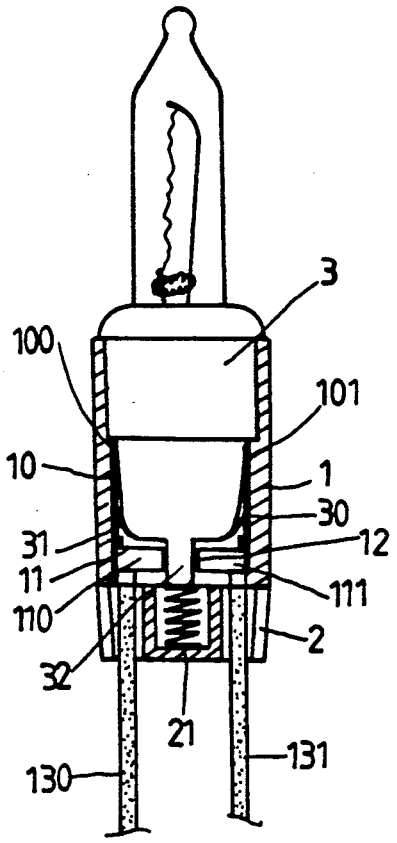
FIG. 1 is a plan view of the preferred embodiment of the present invention.
Figure 2:
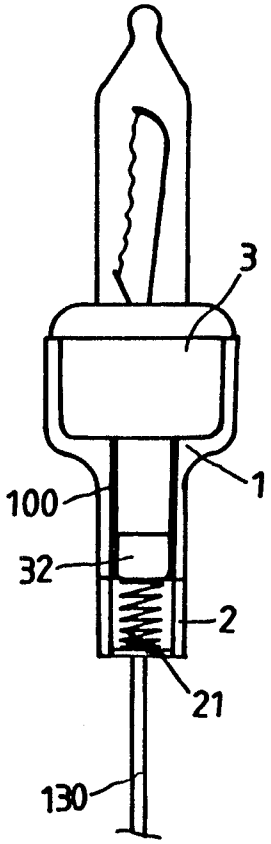
FIG. 2 is a side sectional view thereof.
Figure 3:
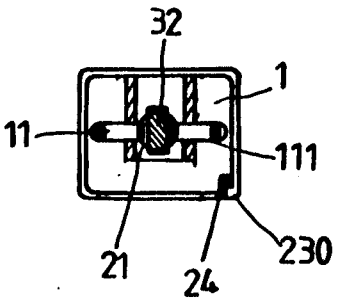
FIG. 3 is a cross section thereof taking in a transverse direction.
Figure 4:
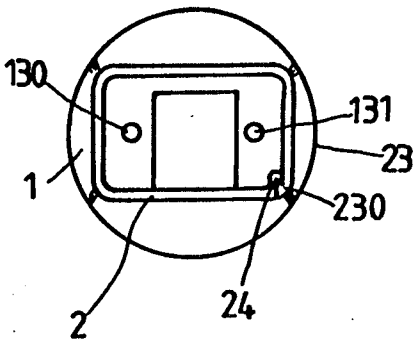
FIG. 4 is a bottom view thereof.
Figure 5:
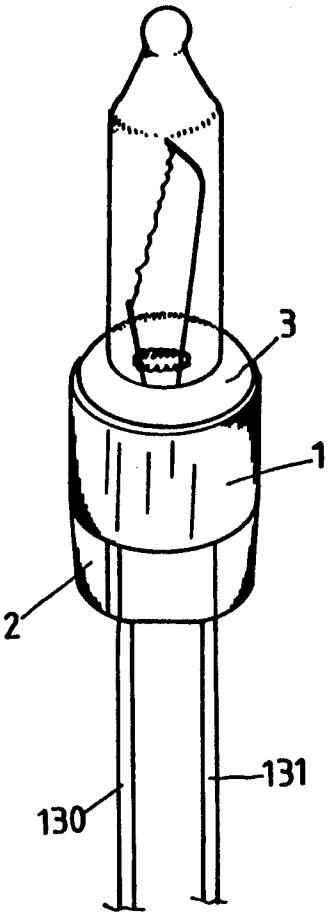
FIG. 5 is an elevational view thereof.
Figure 6:
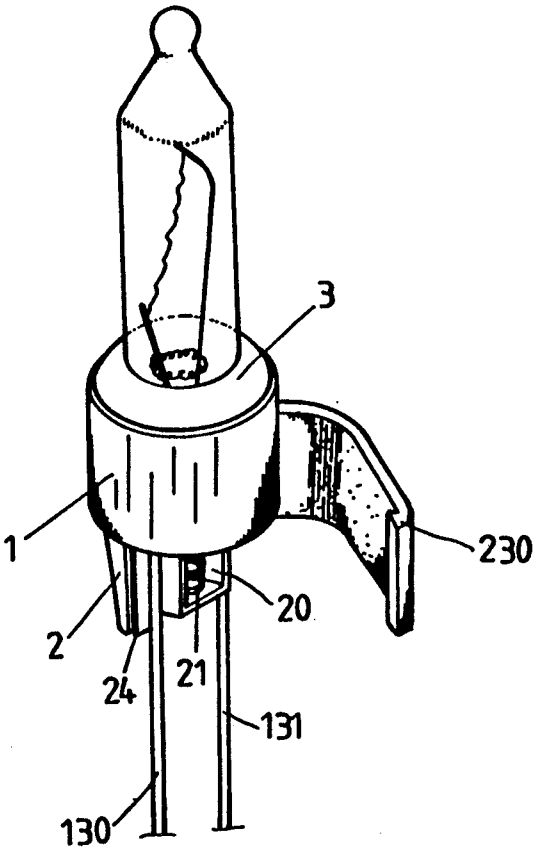
FIG. 6 is another elevational view thereof showing that the covering is opened.

Referring to the annexed drawings in detail, a lamp holder as constructed in accordance with the present invention is generally comprised of a major lamp base 1, an auxiliary lamp base 2, and a lamp socket 3. The major lamp base 1 is made from a plastic tube having two opposite copper leaves 10 at the inside, namely, a first copper leaf 100 and a second copper leaf 101 respectively connected to a switch 11. The switch 11 includes two copper leaves 110, 111 fastened inside the major lamp base 1 at a bottom thereof with a gap 12 defined therebetween. The copper leaf 100 is connected to a lead wire 130 by the copper leaf 110 while the copper leaf 101 is connected to another lead wire 131 by the copper leaf 111. The lead wires 130, 131 are connected to the power supply of a decorative string or Christmas tree light assembly. The auxiliary lamp base 2 is made from a plastic tube cut opened and attached to the major lamp base 1 at the bottom and covered by a covering 23. The covering 23 has a hook 230 hooked in a groove 24 on the auxiliary lamp base 2 (see FIG. 4). A conductive spring 21 is mounted on a spring seat 20 inside the auxiliary lamp base 2 which when in an expanded status stops in gap 12 between the copper leaves 110, 111 causing them to short circuit. The lamp socket 3 comprises a unitary insulator 32 on a bottom edge thereof and two conductors 30, 31 at two opposite sides.

The assembly process of the lamp holder is outlined hereinafter. Insert the lamp socket 3 into the major lamp base 1 permitting the two conductors 30, 31 to contact the copper leaves 100, 101 respectively tightly and permitting the insulator 32 to insert through the gap 12 and press on the conductive spring 21. Therefore, the copper leaves 110, 111 are disconnected from each other. When the lamp socket 3 is connected to an electric power supply, the lamp bulb fastened therein is turned on to emit light. If the lamp socket 3 is disconnected from its position or not properly inserted into the major lamp base 1, the conductive spring 21 is released from the constraint of the insulator 32 and expands to stop against the copper leaves 110, 111 causing them to short circuit, and therefore, the lead wires 130, 131 are connected to transmit the electric current from the electric power supply to another lamp holder in the same decorative string or Christmas tree light assembly.

As indicated, the present invention utilizes a switch to detect the connection of a lamp socket in each lamp holder in a decorative string or Christmas tree light assembly permitting the electric circuit of such decorative string or Christmas tree light assembly to be constantly electrically connected even if either lamp socket of such decorative string or Christmas tree light assembly is disconnected or damaged. Therefore, the present invention makes the inspection and repair of a decorative string or Christmas tree light assembly more easy and inexpensive.

What is claimed is:

1. For a Christmas tree light assembly, a lamp holder with switch means comprising a major lamp base supported on an auxiliary lamp base to hold a lamp socket, wherein:

said major lamp base is made from a plastic tube having a switch at a bottom thereof, a first copper leaf and a second copper leaf at two opposite locations respectively connected to said switch, said switch being comprised of two opposite copper leaves with a gap defined therebetween, the two opposite copper leaves of said switch each having one end connected to a respective one of said copper leaves of said major lamp base and an opposite end connected to a power supply for the Christmas tree light assembly by a lead wire;

said auxiliary lamp base is made from a plastic tube cut opened and attached to said major lamp base, having a conductive spring mounted on a spring seat therein, said spring being to insert into said gap causing the copper leaves of said switch to short circuit; and said lamp socket has a unitary insulator on a bottom edge thereof inserted into said gap to electrically disconnect the copper leaves of said switch from said spring to thereby break the short circuit.

2. The lamp holder of claim 1, wherein said auxiliary lamp base is made from a plastic tube cut open and covered with a covering, said covering having a hook releasably hooked in a retaining groove on said auxiliary lamp base.

* * * * *